US006073738A

United States Patent [19]

Abraham et al.

[11] Patent Number: 6,073,738

[45] Date of Patent: Jun. 13, 2000

[54] ARTICLE OF LUGGAGE HAVING DIVIDER FOR OPPOSING SECTIONS

[75] Inventors: J. Richard Abraham, Pittsburgh; Hyun S. Kim, New Castle, both of Pa.

[73] Assignee: Airway Industries, Inc., Ellwood City, Pa.

[21] Appl. No.: 09/033,809

[22] Filed: Mar. 3, 1998

[51] Int. Cl.[7] ..... A45C 5/12; A45C 5/14; A45C 13/30

[52] U.S. Cl. ..... 190/109; 190/18 A; 190/36

[58] Field of Search ..... 190/18 A, 115, 190/109, 111, 112, 36

[56] References Cited

U.S. PATENT DOCUMENTS

| | | | |
|---|---|---|---|
| 1,224,250 | 5/1917 | Wheary . | |
| 1,382,964 | 6/1921 | Fasel et al. . | |
| 1,648,195 | 11/1927 | Ritter, Jr. . | |
| 1,681,269 | 8/1928 | Tueckmantel . | |
| 1,742,656 | 1/1930 | Laprade . | |
| 1,799,877 | 4/1931 | Wheary et al. . | |
| 1,810,786 | 6/1931 | Pownall . | |
| 1,827,542 | 10/1931 | Ritter, Jr. . | |
| 1,866,150 | 7/1932 | Books . | |
| 1,869,418 | 8/1932 | Hamlin . | |
| 1,869,447 | 8/1932 | Wheary . | |
| 1,918,310 | 7/1933 | Wheary . | |
| 1,919,082 | 7/1933 | Wheary . | |
| 1,947,542 | 2/1934 | Wheary | 190/41 |
| 1,947,838 | 2/1934 | Fiss | 190/41 |
| 1,954,607 | 4/1934 | Wheary et al. | 190/41 |
| 1,960,455 | 5/1934 | Ritter, Jr. | 190/41 |
| 1,964,820 | 7/1934 | Kaufmann | 190/41 |
| 1,968,643 | 7/1934 | Hamlin | 190/41 |
| 1,975,294 | 10/1934 | Sand et al. | 190/41 |
| 1,983,721 | 12/1934 | Wheary | 190/41 |
| 1,984,446 | 12/1934 | Wheary | 190/41 |
| 1,987,722 | 1/1935 | Thiss | 190/41 |
| 1,988,530 | 1/1935 | Wheary | 190/41 |
| 1,989,778 | 2/1935 | Wintz | 190/41 |
| 2,028,339 | 1/1936 | Levine et al. | 190/41 |
| 2,062,462 | 12/1936 | Levine | 190/41 |
| 2,148,244 | 2/1939 | Plotkin | 190/41 |
| 2,176,792 | 10/1939 | Currie | 206/7 |
| 2,181,587 | 11/1939 | Plotkin . | |
| 2,206,564 | 7/1940 | Hallman | 190/41 |
| 2,209,171 | 7/1940 | Plotkin | 190/41 |
| 2,245,999 | 6/1941 | Plotkin | 190/51 |
| 2,278,935 | 4/1942 | Levine | 190/41 |
| 2,384,332 | 9/1945 | Nicholas | 223/85 |
| 2,461,216 | 2/1949 | Kleber | 190/41 |
| 2,502,732 | 4/1950 | Lower | 206/7 |
| 2,545,211 | 3/1951 | Platt | 190/41 |
| 2,554,668 | 5/1951 | Doppelt | 190/41 |

(List continued on next page.)

FOREIGN PATENT DOCUMENTS

| | | | |
|---|---|---|---|
| 296 08 155 U | 8/1996 | Germany . | |
| 729340 | 5/1955 | United Kingdom | 190/109 |

*Primary Examiner*—Sue A. Weaver
*Attorney, Agent, or Firm*—Kirk D. Houser; Eckert Seamans Cherin & Mellott, LLC

[57] ABSTRACT

An upright suitcase includes a front section and an opposing rear section, each having an outer panel and a circumferential wall with a bottom edge and a plurality of free edges. The bottom edges are hingedly connected for movement of the opposing front and rear sections between an open position, in which access to the opposing sections is provided, and a closed position, in which all of the edges of the two circumferential walls are in juxtaposition. A zipper closure engages the opposing sections and selectively holds the free edges of the circumferential walls in juxtaposition. A divider panel is positioned within the upright suitcase to at least partially divide the opposing sections from each other when in the closed position. The divider panel has one end flexibly tethered to the rear circumferential wall and is movable into and out of the rear section. Slack connectors connected to the rear circumferential wall are positioned to selectively and flexibly connect the free end of the divider to the rear circumferential wall. Retainer straps connected to the rear section are positioned to engage the divider and draw it toward the outer panel of the rear section.

46 Claims, 10 Drawing Sheets

U.S. PATENT DOCUMENTS

| | | | |
|---|---|---|---|
| 2,649,940 | 8/1953 | Donald et al. | 190/51 |
| 2,673,756 | 3/1954 | Axtell | 190/109 X |
| 2,873,830 | 2/1959 | Wilt | 190/41 |
| 2,918,997 | 12/1959 | Kotkins | 190/41 |
| 3,734,249 | 5/1973 | Wilt | 190/41 B |
| 4,128,150 | 12/1978 | Popkin et al. | 190/103 |
| 4,529,086 | 7/1985 | New | 206/287.1 |
| 4,733,759 | 3/1988 | Shih-Chen | 190/18 A |
| 4,854,431 | 8/1989 | Pulichino, Jr. et al. | 190/108 |
| 4,854,432 | 8/1989 | Carpenter et al. | 190/110 |
| 4,854,602 | 8/1989 | Takeuchi | 190/122 X |
| 4,863,018 | 9/1989 | King et al. | 206/290 |
| 4,880,089 | 11/1989 | Chombert et al. | 190/18 R |
| 4,887,751 | 12/1989 | Lehman | 224/151 |
| 4,925,021 | 5/1990 | Pulichino, Jr. | 206/279 |
| 4,998,603 | 3/1991 | Nordstrom | 190/18 A |
| 5,054,589 | 10/1991 | Bomes et al. | 190/18 A |
| 5,105,920 | 4/1992 | Grebenstein | 190/18 A |
| 5,109,961 | 5/1992 | Bergman | 190/18 A |
| 5,117,951 | 6/1992 | Sisson | 190/13 C |
| 5,150,776 | 9/1992 | Rebenack . | |
| 5,398,807 | 3/1995 | Plath | 206/298 |
| 5,447,261 | 9/1995 | Mitomi et al. | 190/18 A X |
| 5,458,239 | 10/1995 | Plath | 206/298 |
| 5,474,162 | 12/1995 | Shyr et al. | 190/18 A |
| 5,535,880 | 7/1996 | Plath | 206/298 |
| 5,664,652 | 9/1997 | Shamah | 190/18 A |
| 5,671,831 | 9/1997 | Chiu | 190/103 |
| 5,676,223 | 10/1997 | Cunningham | 190/18 A X |
| 5,732,817 | 3/1998 | Plath | 206/298 |

ARTICLE OF LUGGAGE HAVING DIVIDER FOR OPPOSING SECTIONS

FIELD OF THE INVENTION

This invention relates to luggage, and, more particularly, to a suitcase having a clothing panel or a divider panel therein. The invention also relates to a divider for luggage.

BACKGROUND INFORMATION

It is known to employ an internal panel in luggage, such as a suitcase. In some suitcases, an internal clothing panel is employed to form a sub-compartment for holding clothing, such as a suit, dress or coat, therein. In other suitcases, an internal divider panel is employed to form a pair of separate sub-compartments for holding articles, such as clothing or other personal belongings, therein.

U.S. Pat. No. 1,954,607 shows a conventional, non-upright, hand luggage case having a main or bottom section, a cover or top section, and an internal cover or partition. With the bottom section on a horizontal surface, after the hand luggage case is opened, the free portion of the partition rests on supports or brackets carried by the side walls of the bottom section. When access to the bottom section is desired for packing and unpacking, the partition may be releasably held in its raised or open position by engaging a member on the undersurface of the partition in a keeper on the inside surface of the top section. In this manner, a suit which is carried in the top section may be enclosed therein by the partition.

U.S. Pat. No. 2,206,564 shows a carrying case including a body section which is hinged together with a cover or wardrobe section. A curtain is fastened at its upper end to the top wall of the wardrobe section and has fastening straps carrying socket members adapted to be engaged with ball members secured to the body section.

U.S. Pat. No. 2,245,999 shows a luggage case including two complementary or matching sections connected by a hinge. A dust curtain panel, hingedly mounted at an edge of the bottom wall of one of the two sections, may be moved into place as a cover for that section. In one embodiment, the dust curtain panel is mated with an edge strip by slide fastener elements.

One disadvantage of internal panels for luggage is that such panels may contribute to wrinkles in clothing housed in the adjacent internal luggage compartments.

Another disadvantage is that internal panels may present fixed boundaries which limit the volume of the adjacent internal luggage compartments.

Accordingly, there is room for improvement in internal panels for luggage.

SUMMARY OF THE INVENTION

This invention provides an article of luggage comprising a first opposed section and a second opposed section. Each of the opposed sections has an outer panel and a circumferential wall with a first edge and a plurality of second edges. The first edges are hingedly connected for movement of the opposed sections between an open position, in which access to at least one of the opposed sections is provided, and a closed position, in which the edges of the two circumferential walls are in juxtaposition. At least one closure engages the first and second opposed sections and selectively holds the second edges of the circumferential walls in juxtaposition. A divider is positioned within the luggage article to at least partially divide the opposed sections from each other when in the closed position. The divider has one end flexibly tethered to one of the circumferential walls and is movable into and out of one of the opposed sections. The article further comprises at least one of: (a) at least one slack connector connected to one of the circumferential walls and positioned to selectively and flexibly connect the other end of the divider to that circumferential wall, and (b) at least one retainer connected to one of the opposed sections and positioned to engage the divider and draw it toward the outer panel of that opposed section.

A number of preferred refinements include providing a divider including a rigid frame defining a periphery, and a flexible membrane engaging the periphery of the rigid frame. The rigid frame may be a wire frame, and the flexible membrane may be a soft fabric engaging the wire frame to form a generally flat surface.

The divider may form clothing panel means, and at least one slack connector may be positioned to connect the free end of the clothing panel means to one of the circumferential walls to at least substantially close one of the opposed sections.

One of the circumferential walls may have an interior surface with means for holding a hanger. The hanger may be a hanger for a suit, and the interior surface of one of the circumferential walls may have means for securing a portion of the suit. The clothing panel means may include a first surface disposed toward the outer panel of one of the opposed sections, and an opposite second surface disposed toward the outer panel of the other opposed section. The clothing panel means may further include means for securing another portion of the suit. The first surface of the clothing panel means may have at least one pocket. The interior surface of one of the circumferential walls may have at least one pocket.

The retainer may be positioned to engage the divider to substantially close one of the opposed sections. The first opposed section may have a first volume with an article therein, and the second opposed section may have a second volume. The retainer, when positioned to engage the divider and draw it toward the outer panel of the first opposed section, may decrease the first volume and increase the second volume. The second opposed section may have an interior surface with at least one pocket for holding another article.

The article of luggage may be an upright suitcase in which the first opposed section is a rear section having a rear panel, and the second opposed section is a front section having a front panel. The at least one slack connector may be positioned to connect the free end of the divider to the circumferential wall of one of the front and rear sections to at least substantially close one of those sections.

As another aspect of the invention, a divider for an article of luggage comprises a rigid frame defining a periphery, and a flexible membrane engaging the periphery of the rigid frame.

The flexible membrane may include a first flexible membrane, a second flexible membrane, and a peripheral border member which is attached to the peripheries of the first and second flexible membranes, with the rigid frame between the flexible membranes. Preferably, the rigid frame is enclosed between the flexible membranes by the peripheral border member to substantially eliminate slack in the flexible membranes.

Other details, objects, and advantages of the invention will become more apparent as the following description of a present preferred embodiment thereof proceeds.

BRIEF DESCRIPTION OF THE DRAWINGS

In the accompanying drawings, a present preferred embodiment of the invention is illustrated in which.

DESCRIPTION OF A PREFERRED EMBODIMENT

As employed herein, the term "luggage" is intended to include, but shall not be limited to, luggage, case, suitcase, carry-on case, travel case, garment carrier, duffle and a wide range of other devices for lugging clothing, personal belongings and other articles therein.

As disclosed herein, the terms "top", "bottom", "left", "right", "front" and "rear" are exemplary, non-limiting terms which are employed for convenience of reference to the accompanying drawings.

Figure 1:
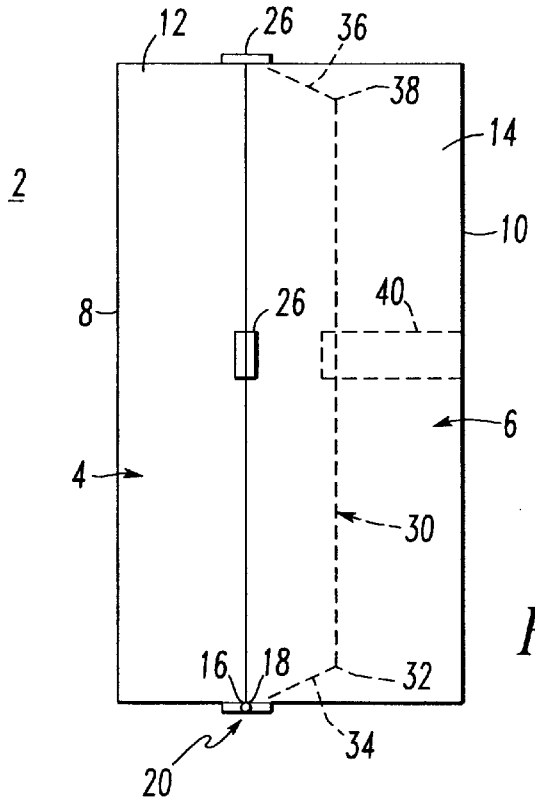
FIG. 1 is a simplified side elevational view of a suitcase in a closed position embodying the present invention.
Figure 2:
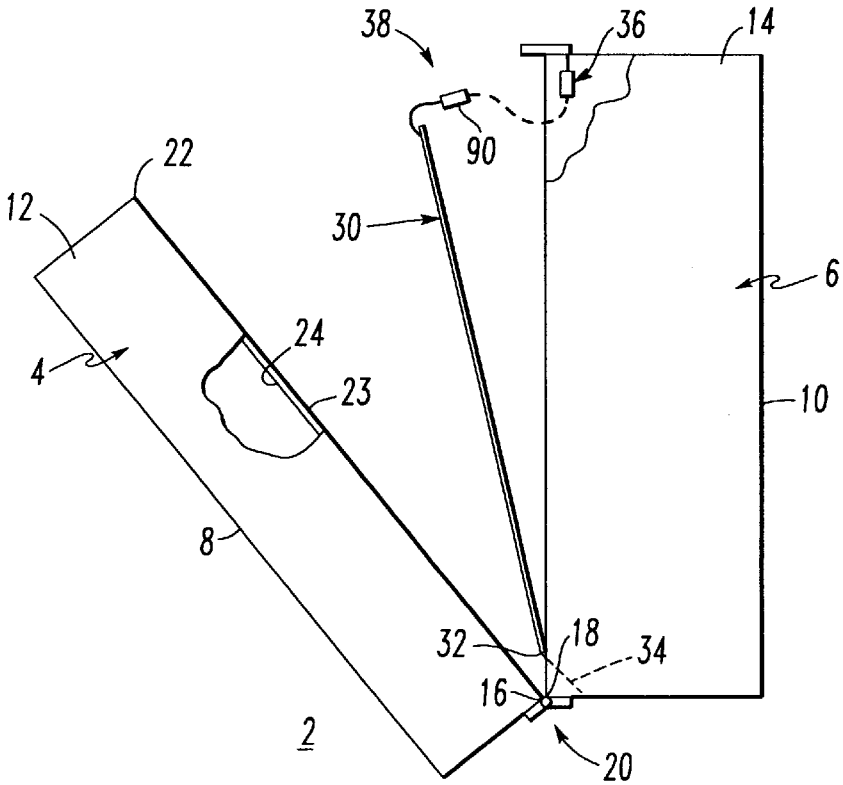
FIG. 2 is side elevational view of the suitcase of FIG. 1 in an open position in which a portion of the rear circumferential wall is broken away for clarity.

Referring to FIGS. 1 and 2, a simplified exemplary upright suitcase 2 is illustrated in a closed position and an open position, respectively. The suitcase 2 includes an opposing front section 4 and an opposing rear section 6 having front and rear outer panels 8,10 and front and rear circumferential walls 12,14, respectively. The walls 12,14 have respective bottom edges 16,18 which form a conventional hinged connection 20 with the corresponding edge of the other wall. As shown with the wall 12 in FIG. 2, the walls 12,14 also have three free edges 22,23,24. The bottom edges 16,18 are hingedly connected for movement of the opposing sections 4,6 between an open position (shown in FIG. 2) in which access to one or both of the opposing sections 4,6 is provided and a closed position (shown in FIG. 1) in which the four edges (16 or 18 and 22,23,24) of each of the circumferential walls 12,14 are in juxtaposition.

Figure 3:
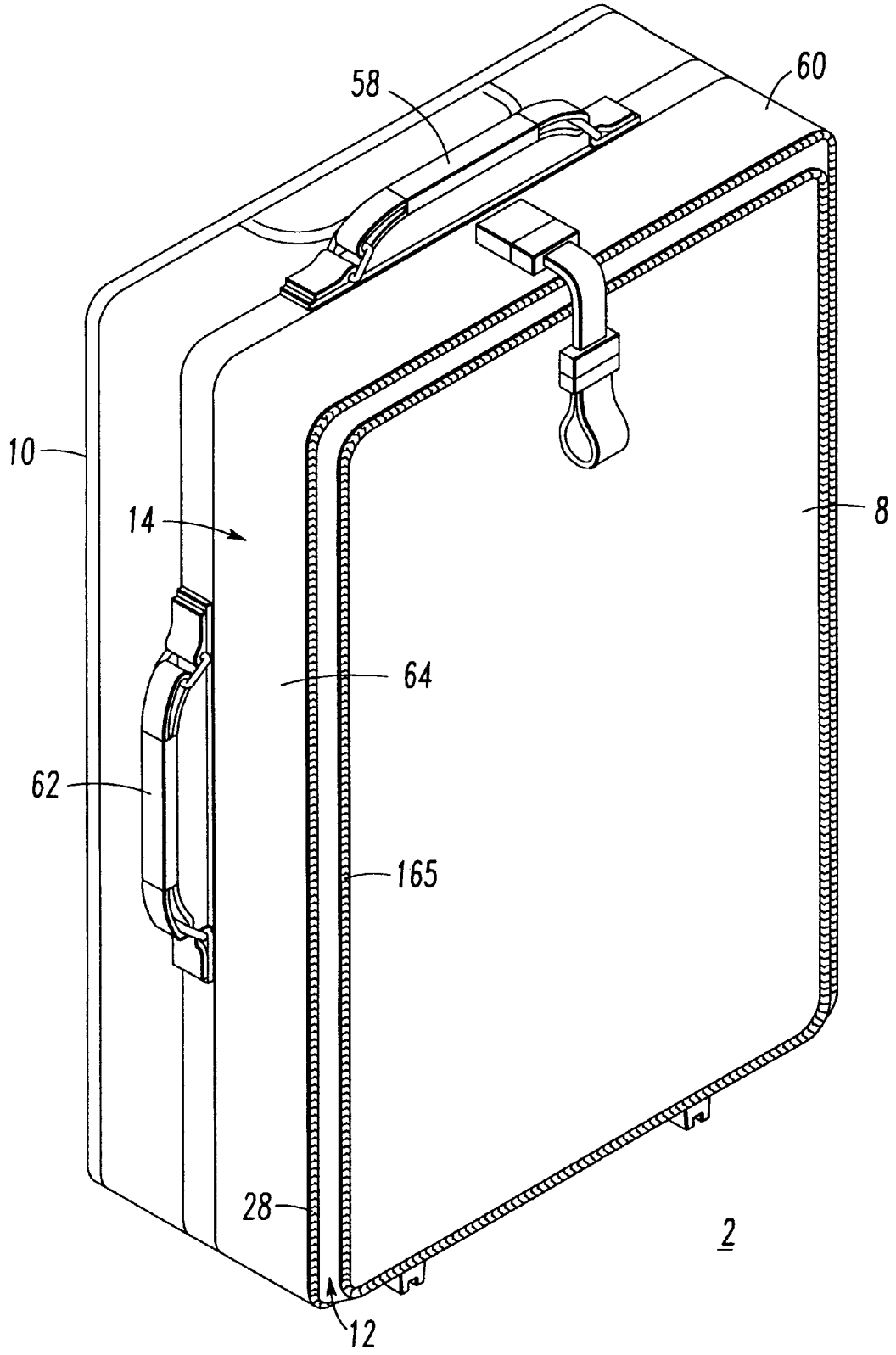
FIG. 3 is a more detailed front perspective view of the suitcase of FIG. 1.
Figure 5:
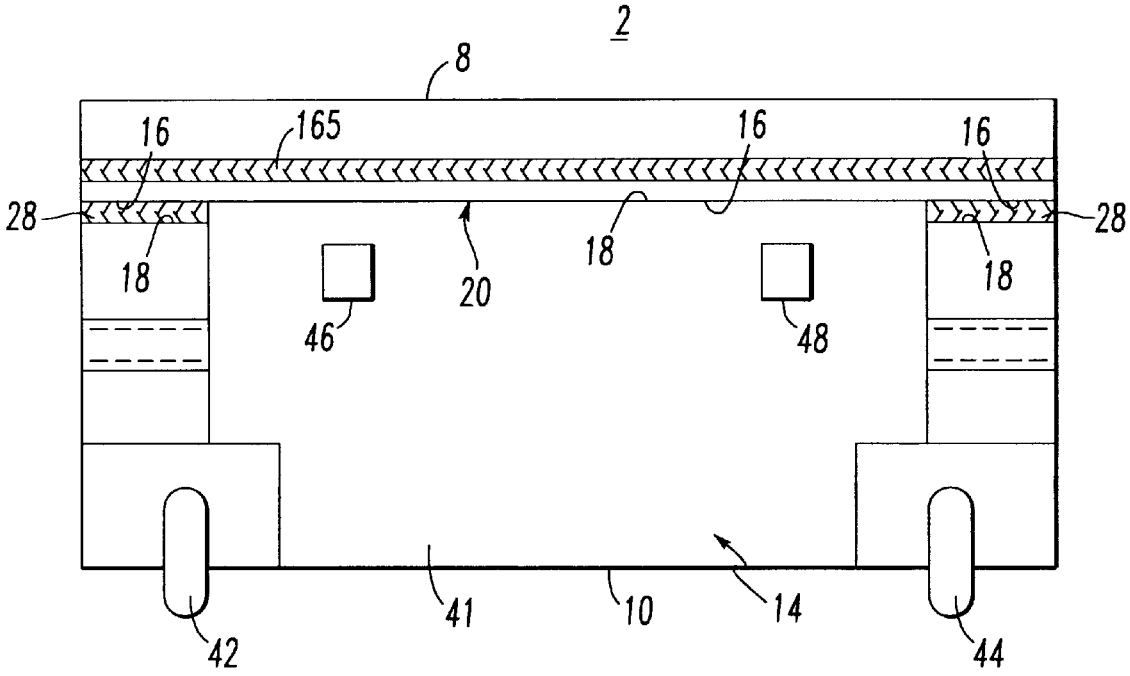
FIG. 5 is a bottom view of the suitcase of FIG. 3.

As shown in FIG. 1, one or more closures 26 engage the front and rear sections 4,6 and selectively hold the free edges 22,23,24 of the circumferential walls 12,14 in juxtaposition. Preferably, as shown in FIG. 3, a slide closure 28, such as a zipper, may be provided about the edges 22,23,24 for opening and closing the suitcase 2, although any suitable closure (e.g., fastener, device for securing free edges of circumferential walls in juxtaposition) known to those skilled in the art may be provided. The zipper 28 is employed to selectively release the free edges 22,23,24 of the circumferential walls 12,14 to permit access to one or both of the front and rear sections 4,6 by a user. As a further refinement, as shown in FIG. 5, the zipper 28 is preferably provided about portions of the bottom edges 16,18 and, hence, extends around three sides and part of the fourth side of the suitcase 2.

A divider panel 30 (shown in hidden line drawing in FIG. 1) is positioned within the suitcase 2 to at least partially divide portions or all of the opposing front and rear sections 4,6 from each other when in the closed position. The divider panel 30 has a bottom end 32 flexibly tethered to the bottom portion of the rear circumferential wall 14 by a flexible tether 34, and is movable into (shown in FIG. 1) and out of (shown in FIG. 2) the rear section 6. Although the exemplary divider panel 30 is flexibly tethered to the rear circumferential wall 14, it will be appreciated that, alternatively, the panel 30 may similarly be flexibly tethered to the front circumferential wall 12 by a front flexible tether (not shown).

As best shown in FIG. 2, one or more slack connectors 36 are connected to the top portion of the rear circumferential wall 14 and are positioned to selectively and flexibly connect the top end 38 of the divider panel 30 to this circumferential wall 14. As shown in FIG. 1, one or more retainers 40 (shown in hidden line drawing) are connected to the rear section 6 and are positioned to engage the divider panel 30 and draw it toward the rear outer panel 10 of the rear section 6. Although the exemplary divider panel 30 is selectively and flexibly connected to the rear circumferential wall 14 and is drawn toward the rear outer panel 10 by the retainers 40 connected to the rear section 6, it will be appreciated that, alternatively, the panel 30 may similarly be selectively and flexibly connected to the front circumferential wall 12 by front slack connectors (not shown) and/or may be drawn toward the front outer panel 8 by front retainers (not shown).

Figure 4:
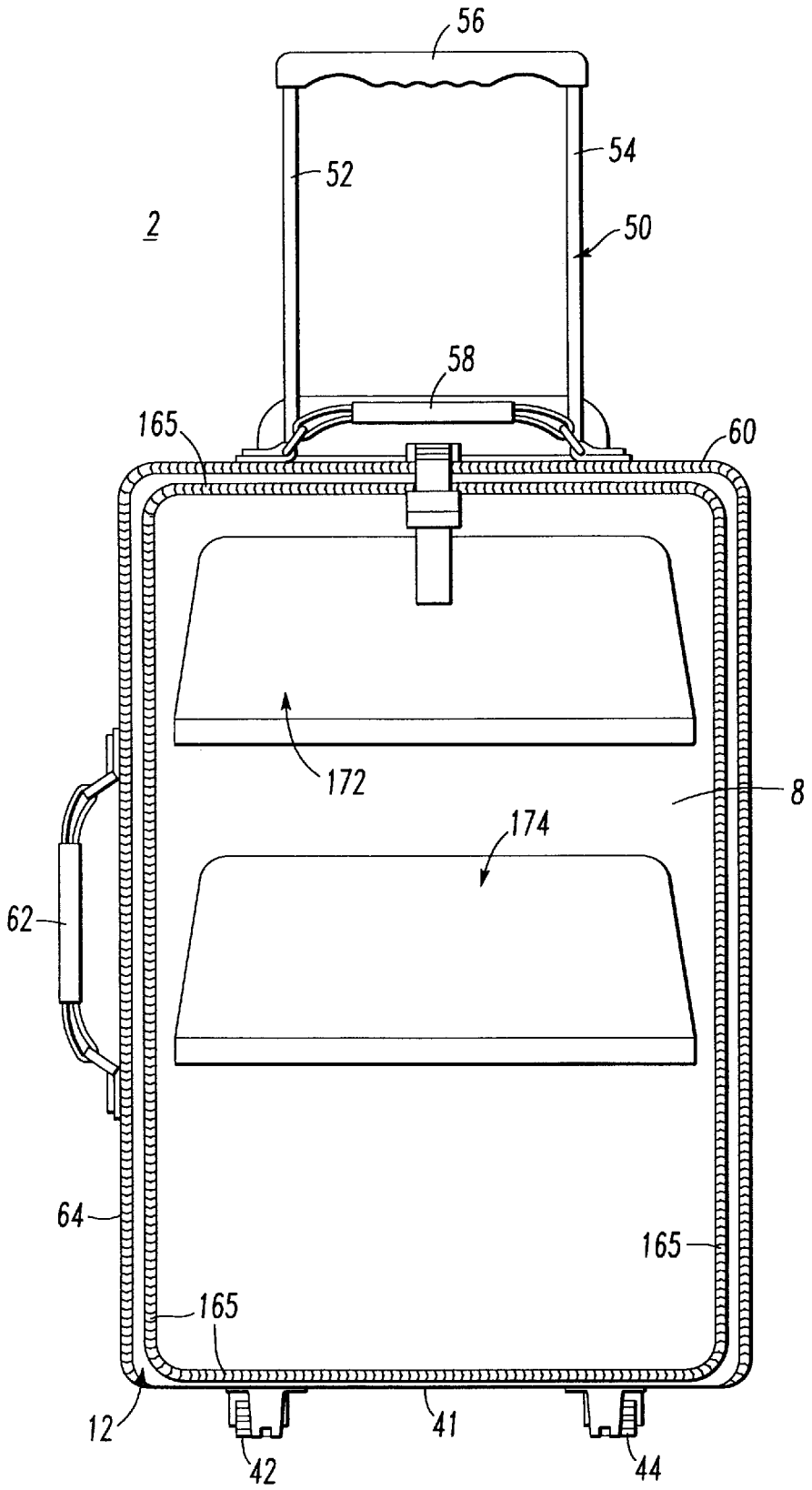
FIG. 4 is a more detailed front elevational view of the suitcase of FIG. 3.

Referring to FIGS. 3 and 4, a detailed front perspective view and a further detailed front elevational view, respectively, of the suitcase 2 are illustrated. The front and rear outer panels 8,10 and the rear circumferential wall 14 are preferably made of soft, flexible material, such as fabric. Also, the rear circumferential wall 14 is preferably provided with a rigid internal spine (not shown) (e.g., a thermoplastic material, any suitably rigid material) extending around a central portion thereof.

As shown in FIG. 5, the rear circumferential wall 14 has a bottom portion 41 and may have a roller mechanism mounted thereto. The exemplary rollers 42,44 are preferably positioned at the junction of rear panel 10 and the bottom portion 41 of the rear circumferential wall 14. The rollers 42,44 are positioned to at least partially support the weight of the suitcase 2 when in the upright, or at-rest, position of FIG. 4. In a preferred embodiment, legs 46,48 are provided on the bottom portion 41 of the rear circumferential wall 14 to support the remainder of the weight of the suitcase 2 when in the upright position. The rollers 42,44 are operable to enable rolling movement of the suitcase 2 across a surface (not shown) in an inclined position (not shown).

A retractable push/pull handle 50, shown in FIG. 4, may be employed by the user to effect rolling movement of the suitcase 2. The push/pull handle 50 is preferably a rigid handle having two legs 52,54 and a gripping member 56.

The handle 50 is alternately retractable into (FIG. 3) and extendable out of (FIG. 4) the volume of the suitcase 2. To enable retraction and extension, the handle 50 preferably includes an extension portion and a carrier (not shown) supported by the rigid spine (not shown). The carrier may include a pair of tubes (not shown) to telescopically receive the legs 52,54 therein for retraction. Such a retraction and extension structure is known to those skilled in the art.

The suitcase 2 may include one or more carry handles mounted on one or more surfaces thereof, such as carry handle 58 mounted on the top portion 60 of the rear circumferential wall 14 and/or carry handle 62 mounted on the side portion 64 of the rear circumferential wall 14. The carry handles 58,62 may be employed by the user to grasp the suitcase 2 and lift it, thereby supporting the entire weight thereof. The carry handles 58,62 may be of any type known to those skilled in the art. Preferably, to permit either of the carry handles 58,62 to fully support the weight of the suitcase 2 and its contents, the top and side portions 60,64 are rigid.

Figure 6:
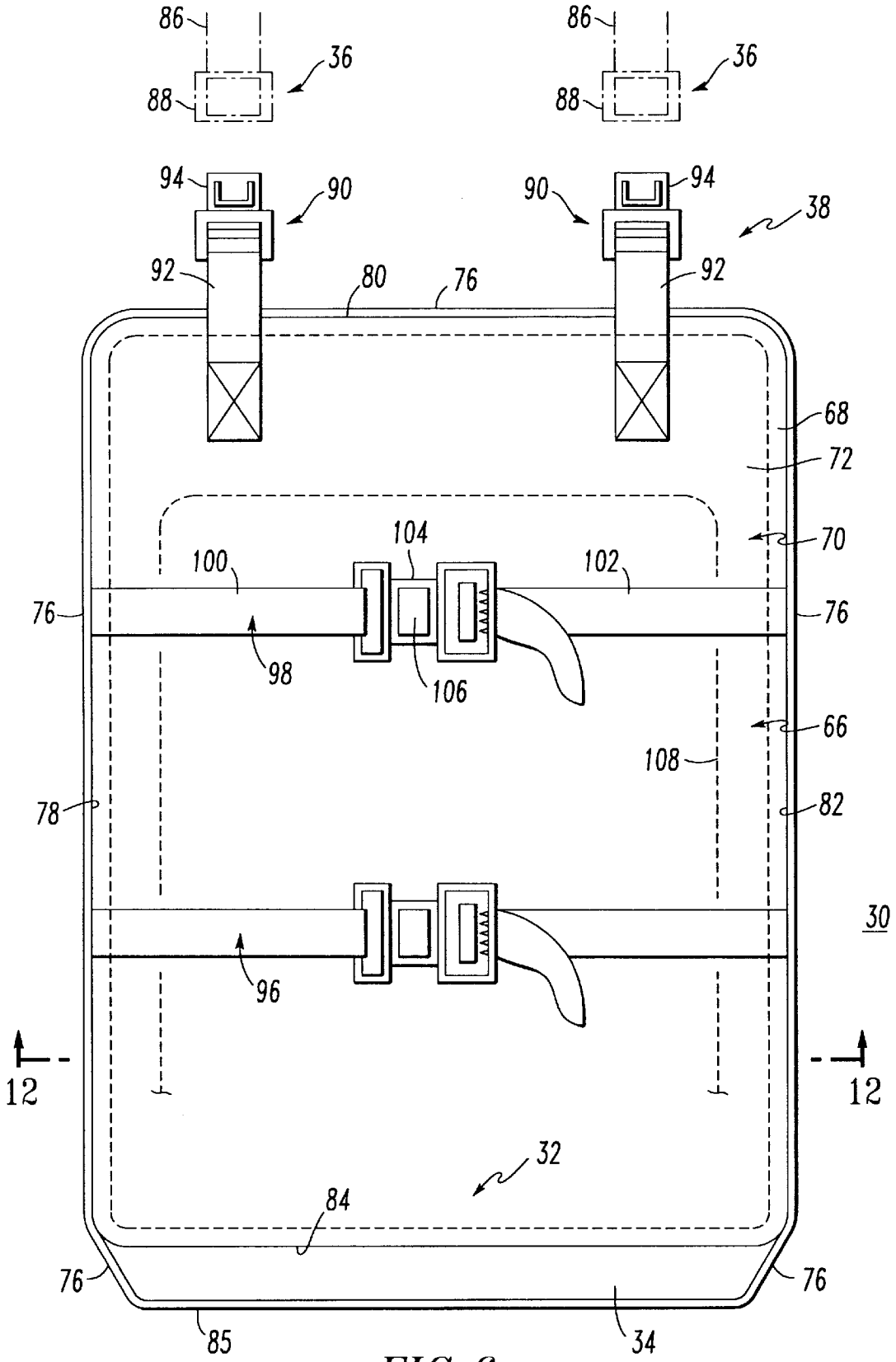
FIG. 6 is a plan view of one side of the clothing panel divider of FIG. 1.
Figure 10:
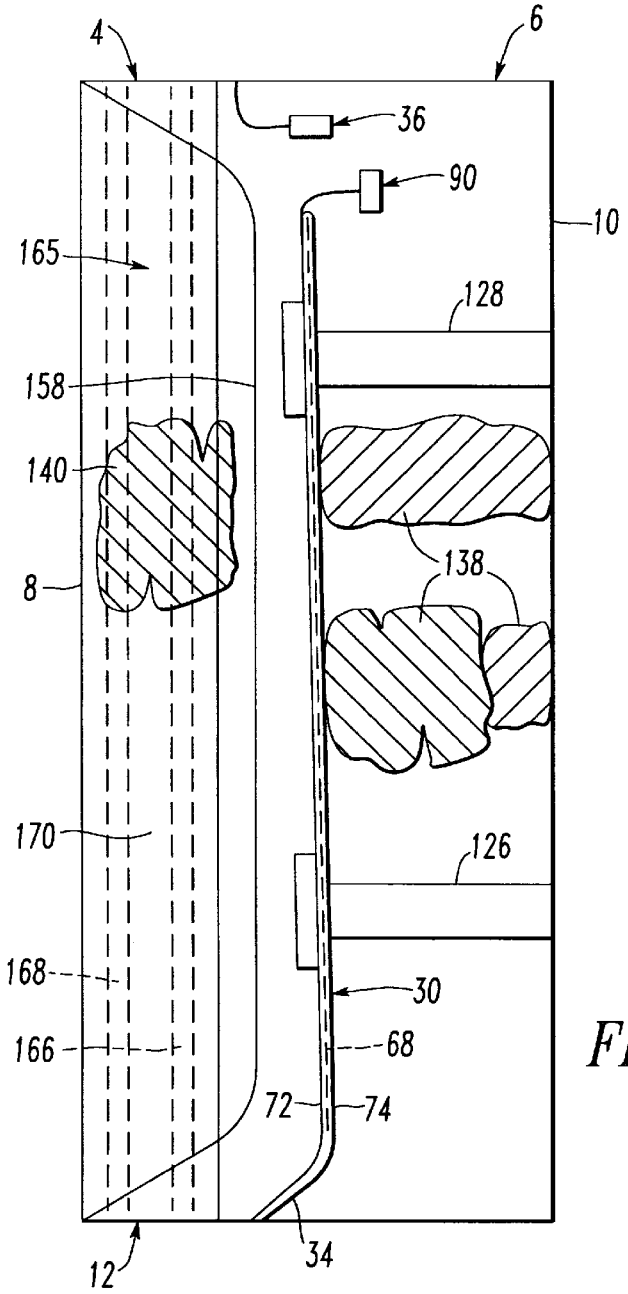
FIG. 10 is a sectional view taken through line 10—10 of FIG. 9, except that the slack connectors are disconnected.
Figure 12:
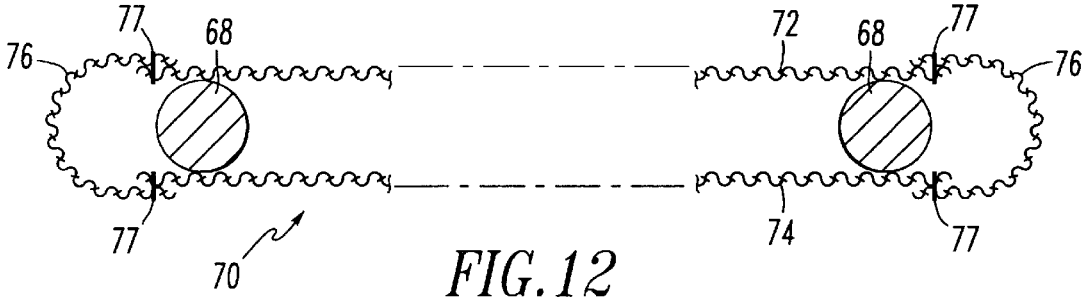
FIG. 12 is a sectional view taken through line 12—12 of FIG. 6.

Referring to FIG. 6, a plan view of the front side 66 of the divider panel 30 is illustrated. The divider panel 30 is preferably formed from a rigid wire frame 68 (shown in hidden line drawing) defining a periphery and a membrane 70 engaging the periphery of the rigid wire frame 68 to form a generally flat surface. The membrane 70 is preferably formed over the rigid wire frame 68 by employing a front soft fabric membrane 72 and a rear soft fabric membrane 74 (both membranes 72,74 are shown in FIGS. 10 and 12) along with a peripheral fabric border 76 suitably attached (e.g., as sewn by exemplary stitching 77 in FIG. 12) to three edges 78,80,82 at the respective left, top and right peripheries of the membranes 72,74. The membranes 72,74 are further sewn together, without the border 76, at the bottom edge 84. Preferably, the rigid wire frame 68 is enclosed between the membranes 72,74, with the sewn border 76 at edges 78,80, 82 and the sewn membranes at edge 84 substantially eliminating and, preferably minimizing, any slack in the membranes 72,74 to render them suitably taut about the four sides of the exemplary frame 68.

At the bottom end 32 of the divider 30, the membranes 72,74 extend beyond the bottom edge 84 to form the flexible tether 34 of FIGS. 1 and 2. Preferably, the membranes 72,74 are further sewn together, with the border 76, at the bottom edge 85 of the tether 34. Although the exemplary divider panel 30 is flexibly tethered to the bottom portion of the rear circumferential wall 14 of the suitcase 2, it will be appreciated that, alternatively, the panel 30 may similarly be flexibly tethered to the top portion.

Figure 8:
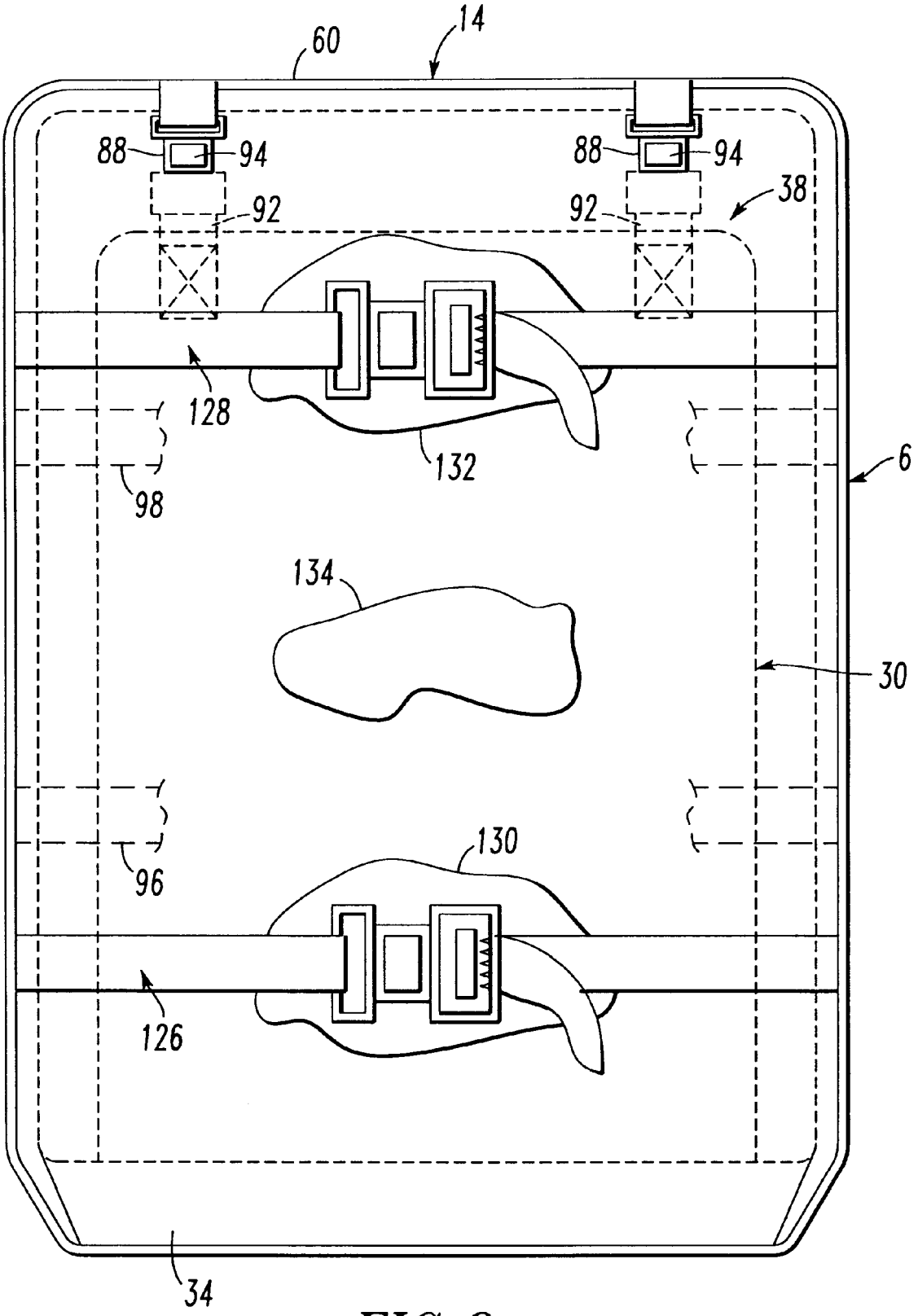
FIG. 8 is a plan view of the rear section of the suitcase of FIG. 1 with the clothing panel divider shown in phantom line drawing in accordance with one embodiment of the invention.

Also referring to FIG. 1, the slack connectors 36 (shown in phantom line drawing in FIG. 6) preferably include a flexible member 86 having a top end attached to the rear circumferential wall 14 and a bottom end attached to a latch member 88. Similarly, the top end 38 of the divider panel 30 includes slack connectors 90 which preferably include a flexible member 92 having a bottom end attached to the front soft fabric membrane 72 and a top end attached to a latch member 94. As shown in FIG. 8, the two pairs of mating latch members 88,94 are engaged to connect the top free end 38 of the divider panel 30 to the rear circumferential wall 14 and, hence, at least substantially close the rear section 6. As shown in FIG. 2, the slack connectors 36,90 are positioned to selectively and flexibly connect the top end 38 of the divider panel 30 to the rear circumferential wall 14. Preferably, the length of the slack connectors 36,90, from the circumferential wall 14 to the top end 38 of the divider 30, is about the same length as that of the tether 34.

Continuing to refer to FIG. 6, the divider panel 30 includes a plurality of adjustable straps 96,98 attached to the left and right sides thereof. As shown with the strap 98, the straps 96,98 include flexible members 100,102 having their inner ends attached to mating latch members 104,106, respectively, and having their outer ends sewn to the edges of the border 76. The straps 96,98 may advantageously be employed to secure or release different portions of an article of clothing, such as the exemplary suit 108 (shown in phantom line drawing).

Figure 7:
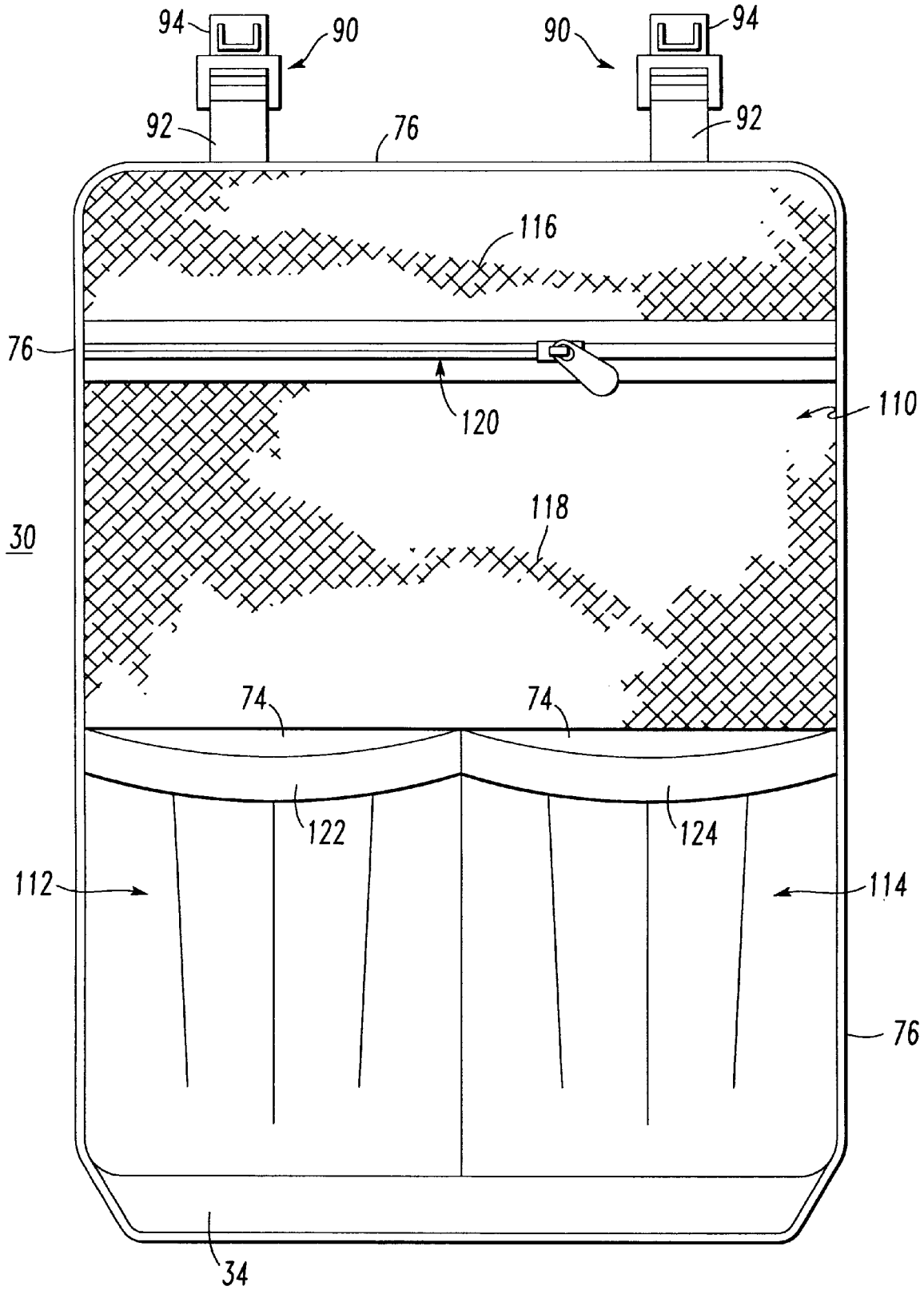
FIG. 7 is a plan view of the other side of the clothing panel divider of FIG. 6.

Referring to FIG. 7, a plan view of the rear side of the divider panel 30 is illustrated. Preferably, the rear side includes one or more of a mesh pocket 110 and/or plural fabric pockets 112,114 for storing various articles, such as clothing or personal belongings therein. The mesh pocket 110 includes a top mesh portion 116, a bottom mesh portion 118 and a slide closure 120, such as a zipper, provided to open and close the mesh pocket 110. The edges of the top and bottom mesh portions 116,118 are suitably attached to the rear soft fabric membrane 74 and/or the edges of the border 76. The fabric pockets 112,114 preferably have elastic members 122,124, respectively, to suitably retain other articles within those pockets.

Referring to FIG. 8, a plan view of the rear section 6 of the suitcase 2 is illustrated with the divider panel 30 (shown in phantom line drawing) functioning in accordance with one embodiment of the invention. In this embodiment, the retainers 40 of FIG. 1, which are shown as exemplary adjustable straps 126,128, are connected to the rear section 6 and positioned to engage articles 130,132 (e.g., clothing, personal belongings), respectively, behind the panel 30. Also, the slack connectors 36,90 are employed to connect the free top end 38 of the divider panel 30 to the circumferential wall 14 to at least substantially close the rear section 6. In this manner, other articles, such as 134, which are not engaged by the retainers 40 of FIG. 1 or the straps 126,128 of FIG. 8, are held in the rear section 6 by the divider panel 30 when the suitcase 2 is opened (shown in FIG. 2) and when the slack connectors 36,90 are engaged to at least substantially close the rear section 6.

Figure 9:
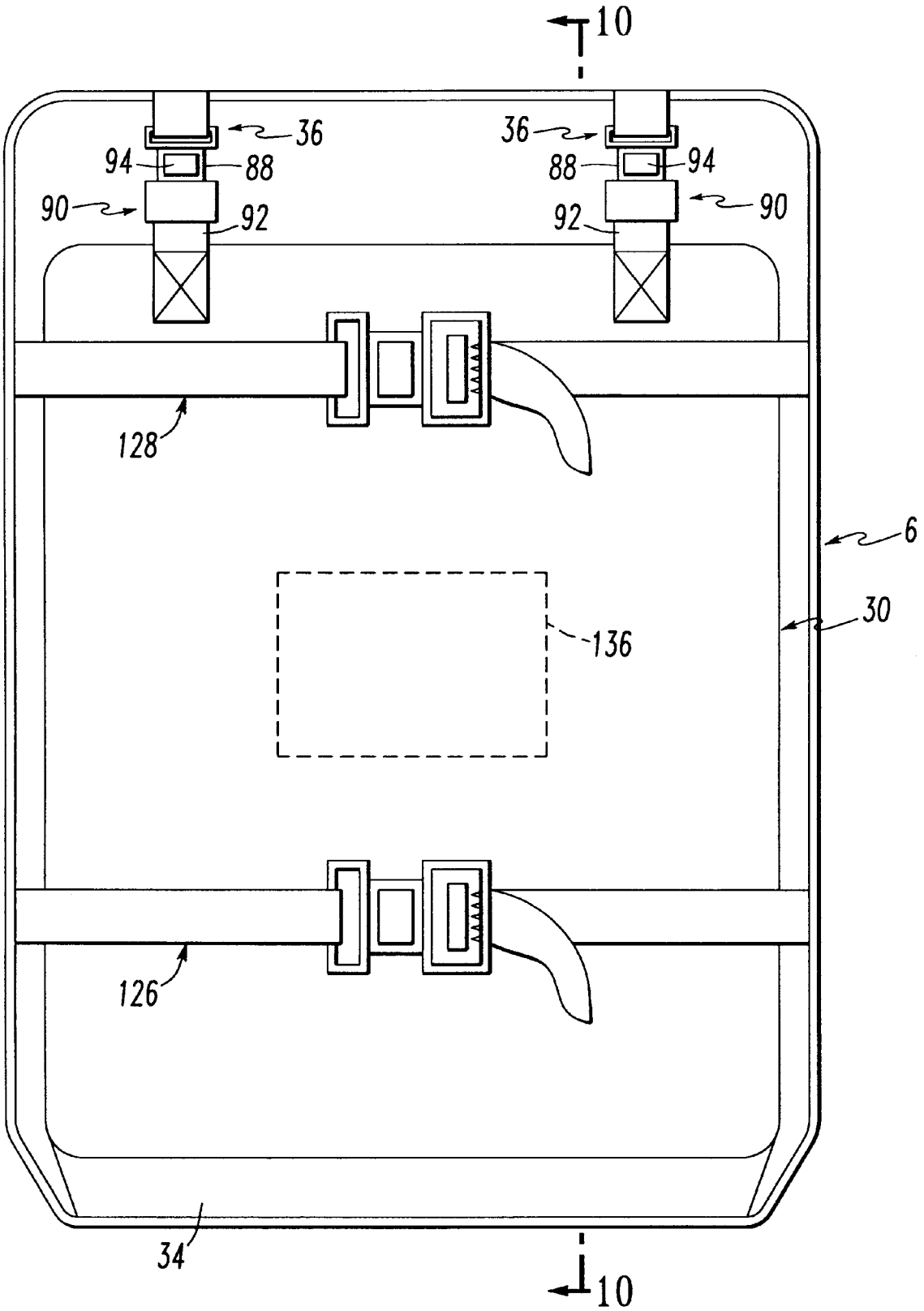
FIG. 9 is a plan view of the rear section and the divider of the suitcase of FIG. 1 in accordance with another embodiment of the invention.

Referring to FIG. 9, a plan view of the rear section 6 and the divider panel 30 are illustrated with the divider panel 30 functioning in accordance with another embodiment of the invention. In this embodiment, the retainers 40 of FIG. 1, which are shown as exemplary straps 126,128 in FIG. 9, are connected to the rear section 6 and are positioned to engage the divider panel 30 and draw it toward the rear outer panel 10 (shown in FIG. 1) of the rear section 6 in the manner discussed above in connection with FIG. 1. Articles (e.g., clothing, personal belongings), such as 136 (shown in hidden line drawing), which are not engaged by the retainers 40 of FIG. 1 or the straps 126,128, are held in the rear section 6 by the divider panel 30 when the suitcase 2 is opened (shown in FIG. 2). Typically, in this embodiment, the slack connectors 36,90 are engaged to at least substantially close the rear section 6, and the straps 96,98 (shown in FIG. 6) of the divider 30 are not be employed.

It will be appreciated that the exemplary divider panel 30, as preferably formed from the rigid wire frame 68 and the front and rear soft fabric membranes 72,74, functions to hold articles, such as clothing, in place in the rear section 6 without subjecting such clothing to wrinkling which might otherwise be caused by other holders, such as the straps 126,128. Furthermore, the flexible tether 34 and the slack connectors 36,90 advantageously permit the retainers 40 of FIG. 1 or the straps 126,128 of FIG. 9, to be employed adjust (i.e., decrease or increase) the storage volume of the rear section 6 and, thus, increase or decrease, respectively, the storage volume of the front section 4 of FIG. 1, by adjustably engaging the divider panel 30 and suitably drawing it toward the outer panel 10 (shown in FIG. 1) of the rear section 6.

Referring to FIG. 10, the front section 4, the rear section 6 and the divider panel 30 are illustrated, with the divider panel 30 functioning in accordance with another embodiment of the invention. This embodiment is similar to the embodiment of FIG. 9, except that the slack connectors 36,90 are disconnected and/or are not employed.

The front soft fabric membrane 72 of the divider 30 is disposed toward the front outer panel 8 of the front section 4 and the rear soft fabric membrane 74 is disposed toward the rear outer panel 10 of the rear section 6. By suitably positioning articles, such as 138, the retainers 40 of FIG. 1 or the straps, 126,128 of FIG. 10 may be employed to engage the divider panel 30 and, thus, substantially close the rear section 6 without the need to employ the slack connectors 36,90. Furthermore, the flexible tether 34 advantageously permits the retainers 40 of FIG. 1 or the straps 126,128 of FIG. 10, to be employed to decrease or increase the storage volume of the rear section 6 and, thus, increase or decrease, respectively, the storage volume of the front section 4 for an article, such as 140, by adjustably engaging the divider panel 30 and suitably drawing it toward the outer panel 10 of the rear section 6.

Figure 11:
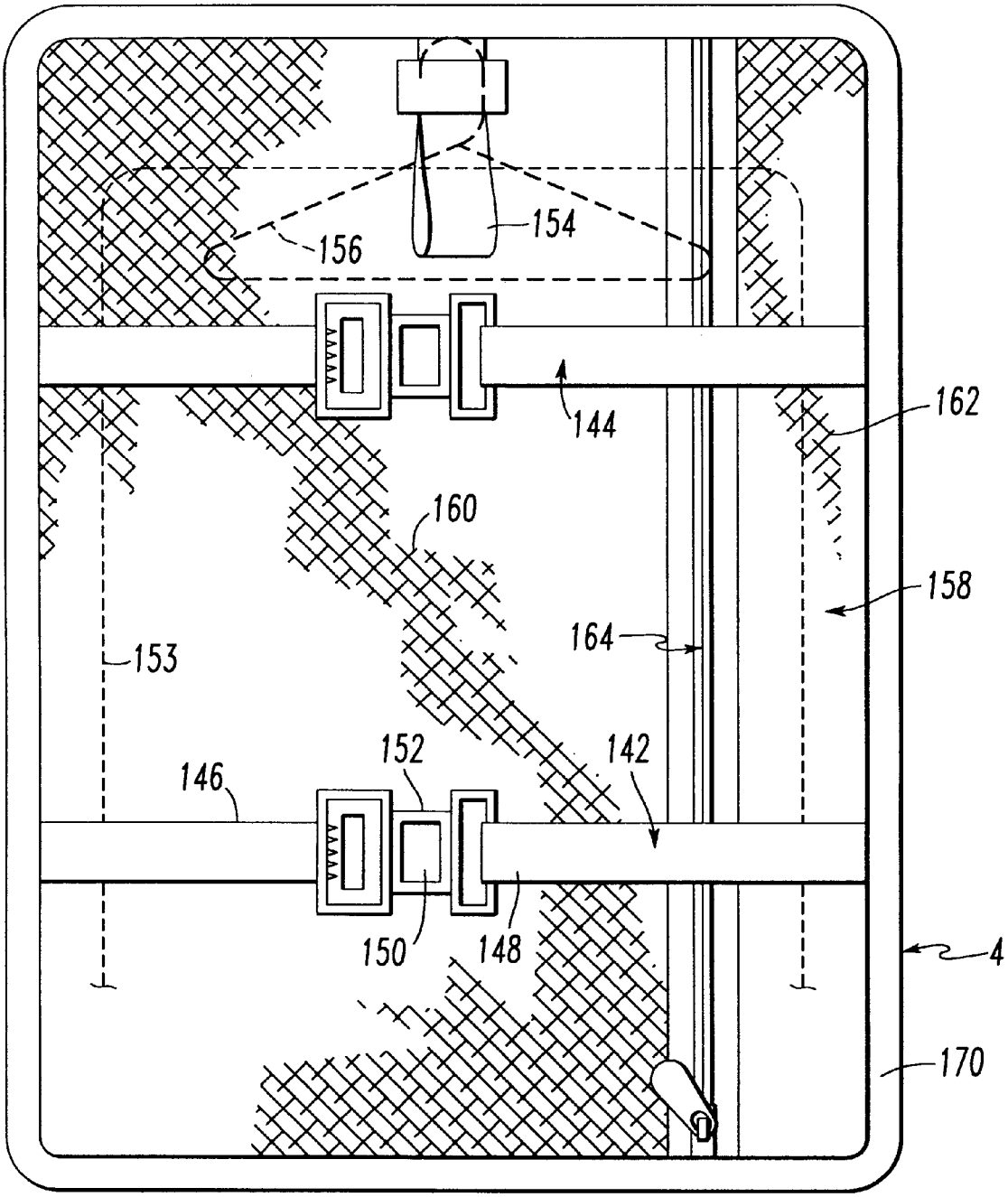
FIG. 11 is a plan view of the front section of the suitcase of FIG. 1.

Referring to FIG. 11, a plan view of the front section 4 of the suitcase 2 is illustrated. The front section 4 includes a plurality of adjustable straps 142,144 attached to the left and right sides of front section 4. As shown with the strap 142, the straps 142,144 include flexible members 146,148 having their inner ends attached to mating latch members 150,152, respectively, and having their outer ends sewn to the inner edges of the front section 4. The straps 142,144 may advantageously be employed to secure and release different portions of an article of clothing, such as the exemplary suit 153 (shown in phantom line drawing).

The top interior surface of the front section 4 has a loop member 154 connected thereto for holding a hanger 156 (shown in phantom line drawing) for the suit 153. It will be appreciated that the suit 108 of FIG. 6 and the suit 153 of FIG. 11 may be a single article of clothing (e.g., a suit, dress, coat) which is hung by the hanger 156, with different portions of this article of clothing held by the straps 144,142 of FIG. 11 and the straps 96,98 of FIG. 6, such that, for example, the strap 144 holds the top portion of the article of clothing, below the hanger 156, and the strap 98 holds the bottom portion of that article of clothing which is folded between the strap 142 of the front section 4 and the strap 96 of the divider panel 30, such that the divider panel 30 functions as a clothing panel or "suiter". In such a configuration, it will be appreciated that when the slack connectors 36,90 of FIG. 6 selectively and flexibly connect the top end 38 of the divider panel 30 to the rear circumferential wall 14 (e.g., as shown in FIG. 1), and when the upright suitcase 2 is opened, the article of clothing, secured by some or all of the straps 144,142,96,98, is accessible by the user, while other articles (e.g., article 134) within the rear section 6 (shown in FIG. 8), may be advantageously held therein by the divider panel 30.

Continuing to refer to FIG. 11, the interior surface of the front section 4 preferably has at least one pocket for holding other articles. The exemplary mesh pocket 158 includes a left mesh portion 160, a right mesh portion 162 and a slide closure 164, such as a zipper, provided to open and close the mesh pocket 158. The edges of the left and right mesh portions 160,162 are suitably attached to the interior surface of the front section 4 to enclose the pocket 158. When an article (e.g., 140 of FIG. 10) is stored in the pocket 158, the straps 144,142 need not be employed, although it will be appreciated that the straps 144,142 may advantageously be employed to further restrain the article within the pocket 158.

Referring to FIGS. 3–5 and 10, the front circumferential wall 12 has four sides and is preferably expandable and contractible. As best shown in FIG. 4, a slide closure 165, such as a zipper, is provided about all four sides of the front circumferential wall 12. When the zipper 165 is closed (shown in FIGS. 3–5), the front circumferential wall 12 is in its fully contracted position.

On the other hand, when the zipper 165 (shown in hidden line drawing in FIG. 10) is opened, the front circumferential wall 12 expands to accommodate the article 140 within the pocket 158, although such expansion may also be employed to accommodate other articles, such as the suit 153 of FIG. 11. When the zipper 165 is opened, the parting of the zipper halves 166,168 uncovers a flexible portion 170 of the front circumferential wall 12 which unfolds to accommodate the articles within the front section 4. Otherwise, when the zipper 165 is closed to engage the zipper halves 166,168 (e.g., as shown in FIG. 4), the flexible portion 170 is folded (e.g., as shown in FIG. 11) behind the engaged halves 166,168 of the closed zipper 165 to full contract the front circumferential wall 12. It will be appreciated that the zipper 165 may also be opened to accommodate other articles (not shown) within the front pockets 172,174 of the front outer panel 8 of FIG. 4.

Whereas particular embodiments of the present invention have been described above for purposes of illustration, it will be appreciated by those skilled in the art that numerous variations in the details may be made without departing from the invention as described in the appended claims.

What is claimed is:

1. A suitcase comprising:

a first opposed section and a second opposed section, each having an outer panel and a circumferential wall with a first edge and a plurality of second edges, the first edges being hingedly connected for movement of the opposed sections between an open position, in which access to at least one of the opposed sections is provided, and a closed position, in which the edges of the two circumferential walls are in juxtaposition;

at least one closure engaging the first and second opposed sections and selectively holding the second edges of the circumferential walls in juxtaposition;

a divider positioned within said suitcase to at least partially divide the opposed sections from each other when in the closed position thereof, said divider having one end flexibly tethered to one of the circumferential walls and being movable into and out of one of the opposed sections; and at least one slack connector connected to one of the circumferential walls and positioned to selectively and flexibly connect the other end of the divider to the last said circumferential wall.

2. The suitcase of claim 1, wherein said divider includes:

a rigid frame defining a periphery, and a flexible membrane engaging the periphery of the rigid frame.

3. The suitcase of claim 2, wherein said rigid frame is a wire frame, and said flexible membrane is a soft fabric engaging the wire frame to form a generally flat surface.

4. The suitcase of claim 2, wherein said flexible membrane includes a first flexible membrane having a periphery, a second flexible membrane having a periphery, and a peripheral border member which is attached to the peripheries of the first and second flexible membranes, with the rigid frame between said flexible membranes.

5. The suitcase of claim 2, wherein said divider is a clothing panel; and said at least one slack connector is positioned to connect the other end of the clothing panel to the last said circumferential wall to at least substantially close one of the opposed sections.

6. The suitcase of claim 5, wherein said at least one closure selectively releases the second edges of the circumferential walls to open said suitcase to permit access to the other opposed section by a user.

7. The suitcase of claim 1, wherein said divider is a clothing panel; and one of the circumferential walls has an interior surface with means for holding a hanger.

8. The suitcase of claim 7, wherein said means for holding the hanger is a loop connected to said interior surface.

9. The suitcase of claim 7, wherein said interior surface of one of the circumferential walls has at least one pocket.

10. The suitcase of claim 7, wherein the hanger is a hanger for a suit; and said interior surface of one of the circumferential walls has means for securing a portion of the suit.

11. The suitcase of claim 10, wherein said means for securing the portion of the suit includes at least one strap.

12. The suitcase of claim 10, wherein said divider is a clothing panel including a first surface disposed toward the outer panel of one of the opposed sections, and a second surface, which is opposite from said first surface, disposed toward the outer panel of the other opposed section, said second surface having means for securing another portion of the suit.

13. The suitcase of claim 12, wherein the first surface of said clothing panel has at least one pocket.

14. The suitcase of claim 1, wherein one of the circumferential walls is generally rigid.

15. The suitcase of claim 1, wherein one of the circumferential walls is expandable.

16. The suitcase of claim 1, wherein one of the circumferential walls is generally rigid; and one of the circumferential walls is expandable.

17. The suitcase of claim 1, wherein at least one retainer is connected to one of the opposed sections and is positioned to engage the divider and draw it toward the outer panel of the last said opposed section.

18. The suitcase of claim 17, wherein said retainer is positioned to engage the divider to substantially close the last said opposed section.

19. The suitcase of claim 17, wherein the first opposed section has a first volume with an article therein;

the second opposed section has a second volume; and said retainer, when positioned to engage said divider and draw it toward the outer panel of the first opposed section, decreases the first volume and increases the second volume.

20. The suitcase of claim 19, wherein the second opposed section has an interior surface with at least one pocket for holding another article.

21. The suitcase of claim 17, wherein said retainer includes at least one strap.

22. The suitcase of claim 1, wherein said at least one slack connector includes at least one first latch; and said divider includes at least one second latch for engaging said at least one first latch.

23. The suitcase of claim 22, wherein said at least one first latch and said at least one second latch include a plurality of mating latches.

24. The suitcase of claim 22, wherein said at least one slack connector is positioned to connect said other end of the divider to the last said circumferential wall to at least substantially close one of the opposed sections.

25. The suitcase of claim 1, wherein said suitcase is an upright suitcase; and the first opposed section is a rear section having a rear panel, and the second opposed section is a front section having a front panel.

26. The suitcase of claim 25, wherein said at least one slack connector is positioned to connect said other end of the divider to the circumferential wall of one of the front and rear sections to at least substantially close one of said front and rear sections.

27. The suitcase of claim 25, wherein at least one of said front and rear panels is soft; and said at least one closure is a slide closure.

28. The suitcase of claim 25, wherein said divider has a bottom end flexibly tethered to one of the circumferential walls.

29. The suitcase of claim 28, wherein said divider has a top end; and said at least one slack connector is positioned to selectively and flexibly connect the top end of said divider to said one of the circumferential walls.

30. The suitcase of claim 25, wherein one of the circumferential walls has a bottom portion with roller means mounted thereto.

31. The suitcase of claim 30, wherein the last said circumferential wall also has a top portion with means for effecting rolling movement of said upright suitcase across a surface.

32. The suitcase of claim 25, wherein one of the circumferential walls has means for carrying said upright suitcase by a user.

33. The suitcase of claim 32, wherein said means for carrying said upright suitcase is at least one carry handle attached to the last said circumferential wall.

34. The suitcase of claim 33, wherein the last said circumferential wall has a top portion with said carry handle attached thereto.

35. The suitcase of claim 34, wherein the last said circumferential wall has a side portion with said carry handle attached thereto.

36. The suitcase of claim 25, wherein the circumferential walls have four sides; and said at least one closure is a slide closure which extends around at least three of said four sides.

37. The suitcase of claim 36, wherein said slide closure is a zipper.

38. The suitcase of claim 1, wherein one of the circumferential walls has four sides and means for expanding and contracting the last said circumferential wall.

39. The suitcase of claim 38, wherein said means for expanding and contracting includes a slide closure which extends around said four sides.

40. The suitcase of claim 39, wherein said slide closure is a zipper.

41. A divider for a suitcase having a first section and a second section which opposes said first section, with one of the first and second sections having a first interior surface, a second interior surface which opposes said first interior surface, and at least one slack connector connected to said second interior surface, said divider comprising:

a rigid frame defining a periphery having a first end and a second end, a flexible membrane, means for engaging said flexible membrane with the periphery of the rigid frame, means for flexibly tethering said divider at the first end of the periphery to the first interior surface of said suitcase, and at least one slack connector at the second end of the periphery positioned to selectively and flexibly connect to said at least one slack connector of said suitcase.

42. The divider of claim 41, wherein said rigid frame is a wire frame, and said flexible membrane is a soft fabric engaging the wire frame to form a generally flat surface.

43. The divider of claim 41, wherein said flexible membrane includes a first flexible membrane having a periphery and a second flexible membrane having a periphery; and said means for engaging said flexible membrane with the periphery of the rigid frame includes a peripheral border member which is attached to the peripheries of the first and second flexible membranes, with the rigid frame between said flexible membranes.

44. The divider of claim 43, wherein said rigid frame is enclosed between said flexible membranes by said peripheral border member to substantially eliminate slack in said flexible membranes.

45. The divider of claim 41, wherein said flexible membrane includes a first flexible membrane and a second flexible membrane; wherein said means for engaging said flexible membrane with the periphery of the rigid frame includes means for enclosing said rigid frame between said first and second flexible membranes; and wherein said first and second flexible membranes extend beyond the first end of the periphery to form said means for flexibly tethering said divider.

46. The divider of claim 45, wherein said means for enclosing said rigid frame between said first and second membranes includes means for securing an article of clothing to one of said first and second flexible membranes.

* * * * *